US006824479B2

(12) United States Patent
Isogawa et al.

(10) Patent No.: US 6,824,479 B2
(45) Date of Patent: Nov. 30, 2004

(54) GOLF BALL

(75) Inventors: Kazuhiko Isogawa, Kobe (JP); Seiichiro Endo, Kobe (JP); Yoshinori Sano, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/705,949

(22) Filed: Nov. 13, 2003

(65) Prior Publication Data

US 2004/0097302 A1 May 20, 2004

(30) Foreign Application Priority Data

Nov. 15, 2002 (JP) ..... 2002-332497

(51) Int. Cl.[7] ..... A63B 37/14
(52) U.S. Cl. ..... 473/378
(58) Field of Search ..... 473/378, 377, 473/351

(56) References Cited

U.S. PATENT DOCUMENTS 5,427,378 A * 6/1995 Murphy ..... 473/353
5,669,831 A * 9/1997 Lutz ..... 473/377
6,450,900 B2 * 9/2002 Kametani et al. ..... 473/377
6,554,723 B1 4/2003 Kametani et al.
6,748,867 B2 * 6/2004 Kametani et al. ..... 101/491
2001/0003716 A1 1/2001 Kametani et al.

* cited by examiner

*Primary Examiner*—Raeann Gorden
(74) *Attorney, Agent, or Firm*—Birch, Stewart, Kolasch & Birch, LLP

(57) ABSTRACT

The object of the present invention is to provide a golf ball having the individualized appearance as well as the visibility, which the mark should inherently provide, by imparting the luster to the mark, without lowering the durability of the mark.

The golf ball of the present invention comprises a mark on the surface of the golf ball body, and a clear coating layer covering the mark, the mark having a color tone satisfying L≦40 specified by Lab color system, wherein the clear coating layer includes
the base resin; and
the luster material comprising a glass flake and a metal oxide layer coated on the surface of the glass flake.

14 Claims, No Drawings

GOLF BALL

This Nonprovisional application claims priority under 35 U.S.C. §119(a) on Patent Application No(s). 2002-332497 filed in JAPAN on Nov. 15, 2002, the entire contents of which are hereby incorporated by reference.

BACKGROUND OF THE INVENTION

1. Field of the Invention

The present invention relates to a golf ball having a mark thereon, more particularly to a golf ball which has an improved luster (brilliance) and visibility of the mark without lowering the durability of the mark.

2. Description of the Related Art

A golf ball generally has printed marks representing a brand name, a play number and the like on a surface of the golf ball body. The play number is a numeral or the like which is printed separately from the brand name. The play number allows golfers playing together to distinguish their respective balls from each other, even if the balls used by them are of the same sort. A commercially-available one-dozen golf ball carton, for example, contains four groups of golf balls bearing four printed play numbers 1, 3, 5 and 7, respectively, each group consisting of three balls.

In general, it is required for such marks to have the visibility, which allows the golfers to distinguish their own balls from each other. Further, in recent years, golfers tend to prefer the mark having luxurious and unique appearance. Japanese unexamined patent publication No. H11-114093 discloses a golf ball where the gloss or luster (brilliance) is imparted to the appearance of the mark. The mark is printed with the ink composition which comprises the pigment and metal powder, and the mark has a good and unique appearance having a metallic luster.

Japanese unexamined patent publication No. H11-319147 discloses a golf having the improved appearance of the mark. The mark is printed with the ink composition comprising the luster-developing component. The appearance of the golf ball was enhanced by reflecting such a light as sunlight efficiently.

SUMMARY OF THE INVENTION

In a method of mixing a metal powder or luster-developing component into the ink composition as disclosed in Japanese unexamined patent publication Nos. H11-114093 and H11-319147, the luster of the metal powder or luster-developing component is weakened by the tinting power (or opacifying power) of the pigment. Thus, the desired luster is not obtained. If the amount of the metal powder or the luster-developing component is increased in order to obtain the desired luster, the adhesion of the mark is lowered. Thus, the mark tends to peel off, when the golf ball is repeatedly hit. As a result, it is not possible to obtain the visibility, which the mark should inherently provide. In addition, if the mark is provided with the luster, it is possible to enhance the visibility of the mark from a long distance as well as impart the luxurious appearance to the mark.

The present invention has been achieved in view of the above circumstances. The object of the present invention is to provide a golf ball having the individualized appearance as well as the visibility, which the mark should inherently provide, by imparting the luster (brilliance) to the mark, without lowering the durability of the mark.

The present invention provides a golf ball comprising a mark on the surface of the golf ball body, and a clear coating layer covering the mark, the mark having a color tone satisfying L≦40 specified by Lab color system, wherein the clear coating layer includes
- the base resin; and
- the luster material comprising a glass flake and a metal oxide layer coated on the surface of the glass flake.

Since the luster material is contained in the clear coating layer which covers the mark, the luster can be imparted to the mark without lowering the durability. Further, since the mark has a color tone satisfying L≦40 specified by Lab color system, the luster of the mark can be emphasized.

DESCRIPTION OF THE PREFERRED EMBODIMENT

The golf ball of the present invention comprises a mark on the surface of the golf ball body, and a clear coating layer covering the mark, the mark having a color tone satisfying L≦40 specified by Lab color system, wherein the clear coating layer includes
- the base resin; and
- the luster material comprising a glass flake and a metal oxide layer coated on the surface of the glass flake.

First of all, the clear coating layer will be explained. The clear coating layer is formed to cover the mark printed on the surface of the golf ball body. For example, in one embodiment, the clear coating layer may cover the whole surface of the golf ball body. In another embodiment, the clear coating layer may cover the mark and a surrounding of the mark only. In both embodiments, since the entire mark is covered with the clear coating layer, it is possible to impart the luster to the mark, thereby improving the visibility of the mark. In the present invention, "surface of the golf ball body" includes a surface of the golf ball body which is treated with an enamel paint or a primer, if required, and a surface of the golf ball body which is not treated with a paint or a primer.

In one embodiment, the clear paint layer may be further formed on the clear coating layer, after the clear coating layer is formed to cover the mark. In a preferred embodiment, the clear coating layer is formed as an outermost layer to concurrently serve as a clear paint layer. In general, the clear paint layer is formed to improve the appearance of the golf ball, protect the mark, and impart the gloss. Thus, it is possible to simplify the surface treatment process of the golf ball by making the clear coating layer have a function of the clear paint layer. In addition, the clear coating layer is characterized in covering the mark having a color tone satisfying L≦40 specified by Lab color system. Making the color tone of the mark itself as dark as L≦40 provides an improved visibility when the clear coating layer comprising the luster material is formed on the mark. The L value of the color tone of the mark is preferably not more than 33, more preferably not more than 30, most preferably not more than 15 to emphasize the luster. The L value of the color tone of the mark is preferably not less than 1, more preferably not less than 5, most preferably not less than 10.

The extremely small L value will raise the cost of the raw material for forming the mark. "Lab color system" as used herein is specified by JIS-Z-8701 or JIS-Z-8729. A Lab color difference is determined by converting tristimulus values X, Y and Z as follows. In the measurement, there is used a color difference meter named "CR-221" manufactured by MINOLTA CO. in which a tristimulus values direct measuring method is adopted.

$$L=116\times(Y/Yn)^{1/3}-16$$

$$a=500\times[(X/Xn)^{1/3}-(Y/Yn)^{1/3}]$$

$$b=200\times[(Y/Yn)^{1/3}-(Z/Zn)^{1/3}]$$

where Xn, Yn, and Zn are tristimulus values in the XYZ coordinate system of a perfect diffuse reflection surface. The "L" value is an index of brightness. A larger "L" value indicates a brighter color. The "a" and "b" values are indexes of hue. The color varies toward red as the "a" value is increasing, while on the other hand the color varies toward green as the "a" value is decreasing. The color varies toward yellow as the "b" value is increasing, while on the other hand the color varies toward blue as the "b" value is decreasing.

The mark having the color tone satisfying L≦40 is, for example, formed by printing with the ink composition for forming the mark on the surface of the golf ball body and drying it. The ink composition, for example, without limitation, includes the resin for the ink and a pigment in such an amount as to provide the mark having the color tone satisfying L≦40. The resin for the ink can be in the form of so-called two-component curing type of resin in order to improve the durability of the mark. An example of the pigment is a carbon black.

The clear coating layer includes the base resin and the luster material which comprises a glass flake and a metal oxide layer coated on the surface of the glass flake. The base resin, for example, without limitation, includes an acrylic resin, an epoxy resin, a urethane resin, a polyester type resin, a cellulose type resin and the like. Among them, the acrylic resin, the epoxy resin and the urethane resin are preferable, because they have high transparency.

In the case that the clear paint layer is further formed on the clear coating layer, the epoxy resin is preferably used as the base resin of the clear coating layer, because the use of the epoxy resin enhances the durability of the mark. An example of the epoxy resin is "PAD-EPH ink 00 medium (resin component: 43%)" manufactured by Navitas Corporation.

In the case that the clear paint layer is formed on the clear coating layer, or in the case that the clear coating layer is made the outermost layer, the base resin for the clear coating layer (or the clear paint layer), for example, without limitation, includes the acrylic resin, the epoxy resin, the urethane resin, the polyester type resin, the cellulose type resin and the like as described above. Among them, the two-component curing urethane resin as described later is preferable. In general, the use of the two-component curing type of urethane resin provides the clear coating layer (or the clear paint layer) with an excellent durability.

The two-component curing type of urethane resin is a urethane resin obtained by the curing reaction between the base resin and the curing agent. For example, the urethane resin is obtained by the curing reaction between the base resin containing a polyol component and a polyisocyanate or a derivative thereof.

The base resin containing the polyol component, preferably includes the following specific urethane polyol. The urethane polyol is, for example, obtained by the reaction between a polyol and a polyisocyanate. The polyisocyanate for producing the urethane polyol is not limited, as long as it has at least two isocyanate groups. Examples of the polyisocyanate are an aromatic polyisocyanate such as 2,4-tolylene diisocyanate, 2,6-tolylene diisocyanate, a mixture (TDI) of 2,4-tolylene diisocyanate and 2,6-tolylene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate(TMXDI) and paraphenylene diisocyanate (PPDI); and an alicyclic or aliphatic polyisocyanate such as 4,4'-dicyclohexylmethane diisocyanate (hydrogenated MDI), hydrogenated xylylenediisocyanate($H_6$XDI) hexamethylene diisocyanate (HDI), and isophorone diisocyanate (IPDI). The polyisocyanate can be used either alone or in combination of two or more. Among them, non-yellowing type polyisocyanate (TMXDI, XDI, $H_6$XDI, IPDI, $H_{12}$MDI) are preferable in view of weather resistance. In addition, the above polyisocyanate can be used as a curing agent for curing the urethane polyol.

The polyol for producing the urethane polyol is not limited, as long as it has a plurality of hydroxyl groups. The polyol includes, for example, a low-molecular weight of polyol and a high-molecular weight of polyol.

Examples of the low-molecular weight of polyol are a diol such as ethylene glycol, diethylene glycol, triethylene glycol, butylene glycol, 1,3-butanediol, 1,4-butanediol, neopentyl glycol, 1,6-hexane glycol; or a triol such as glycerin, trimethylol propane, hexanetriol.

Examples of the high-molecular weight of polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. Among them, the polyol having a weight average molecular weight of 50 to 2000 is preferably used, more preferably, the polyol having a weight average molecular weight of about 100 to about 1000 is used. The above polyol can be used individually or in combination of at least two of them.

The urethane polyol is a polyol having a hydroxyl group at the terminal thereof and has a urethane bond which is formed by the reaction between the above polyisocyanate and the polyol.

Preferably, the urethane polyol has urethane bonds in a ratio of 0.1 to 5 mmol/g with respect to 1 gram of the urethane polyol. The ratio of urethane bond affects the stiffness of the resulting clear coating layer (or a clear paint layer). If the ratio of urethane bonds is less than 0.1 mmol/g, the concentration of the urethane bond in the clear coating layer (or clear paint layer) becomes too low to provide a sufficient scuff resistance. If the ratio of urethane bonds is greater than 5 mmol/g, the clear coating layer (or clear paint layer) has excessively high hardness. Such a hard coating layer (or hard clear paint layer) does not follow the deformation of the golf ball body, resulting in crack of the clear coating layer (or clear paint layer).

The urethane polyol preferably has a weight average molecular weight of 4000 or more, more preferably a weight average molecular weight of 4500 or more, and preferably has a weight average molecular weight below 10000, more preferably a weight molecular weight of 9000 or less. When the molecular weight of the urethane polyol is less than 4000, drying process requires a longer time. As a result, coating workability and productivity of golf balls tends to become low. While if the molecular weight of the urethane polyol is 10000 or greater, the hydroxyl value of the urethane polyol becomes relatively small. Thus, the reaction ratio between the clear coating layer and the surface of the golf ball becomes low. Consequently, the adhesion of the clear coating layer to the surface of the golf ball tends to be low. Further, the use of urethane polyol having a weight average molecular weight of 9000 or less allows the clear coating layer (or a clear paint layer) to form a dense layer which does not lower the adhesion even in a wet condition.

The urethane polyol preferably has a hydroxyl value of not less than 15 mgKOH/g, more preferably not less than 73 mgKOH/g, and preferably has a hydroxyl value of not more than 130 mgKOH/g, more preferably not more than 120 mgKOH/g. If the hydroxyl value is less than 15 mgKOH/g, the reaction between the urethane polyol and the curing agent tends to be insufficient. The insufficient reaction causes the lower adhesion of the clear coating layer to the golf ball body. On the other hand, if the hydroxyl value is more than 130 mgKOH/g, the reaction with the curing agent tends to require longer time, resulting in longer drying time and lower productivity. Further, the crack of the clear coating layer (or clear paint layer) tends to occur at the impact of the shot.

The above urethane polyol is obtainable by reacting the polyisocyanate and the polyol as a raw material in such a ratio that the hydroxyl group of the polyol component is excess to the isocyanate group of the polyisocyanate in a molar ratio. In the reaction for producing the urethane polyol, a solvent or a catalyst (for example, dibutyl tin dilaurate), which is well-known for producing polyurethane, may be used. The ratio of the urethane bond can be controlled by adjusting the blending ratio between the polyisocyanate and the polyol, or by selecting the molecular weight of the polyol as a raw material.

In one preferable embodiment, the polyol constituting the base resin is the above urethane polyol itself, namely, the base resin is substantially the above urethane polyol. In another preferable embodiment, the polyol, which is compatible with the above urethane polyol and has no urethane bond, may be contained in the base resin, in addition to the urethane polyol. In this case, the polyol having no urethane bond includes, without limitation, the above polyol which is described as a raw material for producing the urethane polyol. In the case that the polyol having no urethane bond is contained in the base resin, the amount of the urethane polyol contained in the base resin is preferably not less than 50 mass %, more preferably not less than 80 mass %. If the amount of the urethane polyol contained in the base resin is less than 50 mass %, the content of the urethane polyol becomes relatively small. Thus, the drying time tends to be longer.

In the followings, the luster material used in the present invention will be explained. In the present invention, the clear coating layer includes the base resin and the luster material comprising a glass flake and a metal oxide layer coated on the surface of the glass flake. The luster material develops color by the interference action between the light reflected on the surface of the metal oxide layer and the light which transmits through the metal oxide layer and is reflected on the surface of the glass flake. The random direction of the luster material contained in the clear coating layer provides a diffused reflection, thereby developing the luster.

The luster material comprises a glass flake as a base material. The glass flake has a high transparency and a high surface smoothness, thus the glass flake is excellent in developing the luster. For example, in the case of the aluminum flake, the aluminum is not preferable, because the color of aluminum is too strong. Examples of the metal oxide covering the glass flake are titanium oxide, aluminum oxide, and zinc oxide. Among them, titanium oxide is preferable in view of giving the strong reflecting light. In a preferable embodiment, the titanium oxide has the rutile structure, which is less photocatalystic activity.

The amount of the luster material contained in the clear coating layer is not limited. In the case the clear coating layer is the outermost layer to concurrently serve as the clear paint layer, the amount of the luster material contained in the clear coating layer is preferably not less than 0.5 part by mass, more preferably not less than 0.8 part by mass, even more preferably not less than 2 parts by mass, and preferably not more than 10 parts by mass, more preferably not more than 9 parts by mass, even more preferably not more than 8 parts by mass based on 100 part by mass of the base resin. In the case that the clear paint layer is further formed on the clear coating layer, the amount of the luster material contained in the clear coating layer is preferably not less than 0.5 part by mass, more preferably not less than 2 parts by mass, even more preferably not less than 3 parts by mass, and preferably not more than 20 parts by mass, more preferably not more than 18 parts by mass, even more preferably not more than 15 parts by mass based on the 100 parts by mass of the base resin. In both cases, if the amount of the luster material is less than the lower limit, the luster tends to be insufficient. If the amount is greater than the upper limit, the durability against the impact tends to be lowered. Especially, in the case that the clear coating layer is made the outermost layer, since the clear coating layer is subjected to the direct impact, it is preferable that the amount of the luster material is not more than 10 parts by mass.

The average particle size of the luster material is preferably not less than 10 $\mu$m, more preferably not less than 30 $\mu$m, even more preferably not less than 40 $\mu$m, and preferably not more than 100 $\mu$m, more preferably not more than 90 $\mu$m, even more preferably not more than 80 $\mu$m. If the luster material has the average particle size of less than 10 $\mu$m, the luster becomes weak, while if the luster material has the average particle size of more than 100 μm, the durability becomes low (The coating layer tends to peel off, due to the impact).

The average thickness of the luster material is preferably not less than 0.8 μm, and preferably not more than 8 μm, more preferably not more than 6 μm, even more preferably not more than 5 μm. The luster material having the average thickness of less than 0.8 μm tends to give weaker luster, while the luster material having the average thickness of more than 8 μm tends to lower the durability (The coating layer tends to peel off easily).

The clear coating layer or the clear paint layer formed on the clear coating layer may further contain an additive such as an ultraviolet absorber, an antioxidant, a light stabilizer, a fluorescent brightener, and an anti-blocking agent and the like, which are generally used for the golf ball paint.

The golf ball of the present invention has no limitation on its structure and includes a one-piece golf ball, a two-piece golf ball, a multi-piece golf ball comprising at least three layers, and a wound-core golf ball. The present invention can be applied for all types of the golf ball. In the following, the method for preparing the golf ball of the present invention will be explained based on the embodiment of the two-piece golf ball, but the present invention is not limited to the two-piece golf ball and the process explained below.

The present invention can employ any core which is well-known as the core for the two-piece golf ball. The core of the two-piece golf ball, for example, without limitation, is preferably a molded body which is formed by vulcanizing a rubber composition. The rubber composition preferably comprises a base rubber, a co-crosslinking agent, and a crosslinking initiator.

Examples of the base rubber are butadiene rubber (BR), ethylene-propylene-diene terpolymer (EPDM), isoprene rubber (IR), styrene-butadiene rubber (SBR), and acrylonitrile-butadiene rubber (NBR). Among them, butadiene rubber, particularly cis-1,4-polybutadiene, is preferable in view of its superior repulsion property. Typically preferred is the high cis-polybutadiene rubber having cis-1,4 bond in a proportion of not less than 40%, more preferably not less than 70%, even more preferably not less than 90%.

The co-crosslinking agent used in the present invention includes, for example, an α,β-unsaturated carboxylic acid or a metal salt thereof. Typically preferred is the α,β-unsaturated carboxylic acid having 3 to 8 carbon atoms such as acrylic acid and methacrylic acid or the metal salt thereof. As the metal forming the metal salt of the α,β-unsaturated carboxylic acid, a monovalent or divalent metal such as zinc, magnesium, calcium, aluminum and sodium is preferably used. Among them, zinc is preferable, because it can impart the higher repulsion property to the golf ball. The amount of the co-crosslinking agent to be blended in the rubber composition is preferably from 20 to 50 parts by mass, more preferably 25 to 40 parts by mass based on 100 parts by mass of the base rubber.

As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. The amount of the organic peroxide to be blended in the rubber composition is preferably from 0.2 to 1.5 parts by mass, more preferably from 0.3 to 1.0 parts by mass based on 100 parts by mass of the base rubber.

The rubber composition for the core may further contain a specific gravity adjusting agent such as zinc oxide and barium sulfate, an antioxidant, a color powder, and the like, as required.

The core is formed by press-molding the above rubber composition into the spherical body at the heating conditions. The conditions for the press-molding should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

The core thus obtained is covered with the cover composition to form a golf ball body. The cover composition, for example, includes a thermoplastic resin such as an ionomer resin, a urethane resin; a two-component curing type urethane resin; a balata and a hard rubber. Further, when forming the cover, the cover can be formed with a multiplicity of concavities, which is so called "dimple", at the surface thereof. As required, the surface of the golf ball can be subjected to grinding treatment such as sandblast in order to improve the adhesion of the mark, or the clear coating layer (or the clear paint layer).

After the golf ball body has been prepared, the mark is formed on the surface of the golf ball body. As the method for forming the mark on the surface of the golf ball body, the conventional method can be employed. Examples of the method for preparing the mark are a heat transfer method where the mark is transferred at the heating condition with the transfer foil, and a pad printing method where the mark is transferred by the transfer pad. After the mark is formed in such a way, the clear coating layer is formed to cover the mark. A composition for clear coating layer, which comprises the above base resin and the luster material, is coated and then dried (or cured) to form the clear coating layer. The composition for clear coating layer may further include a solvent to improve the coating ability. In the case that the clear paint layer is further formed on the clear coating layer, the clear paint is coated on the golf ball, and then dried to form a clear paint layer in the same way.

Although the method for preparing the golf ball is explained based on the embodiment of the two-piece golf ball, the wound core can be used for preparing a wound golf ball, and at least one intermediate layer can be formed between the core and the cover for preparing the multi-piece golf ball including at least three layers.

For preparing a wound core golf ball, a conventional wound core can be used in the present invention. The wound core comprises a center and a rubber thread layer which is formed by winding a rubber thread around the center in an elongated state. Examples of the center are a liquid center and a solid center formed of rubber. In the present invention, the rubber thread, which is conventionally used for winding around the center, can be adopted for winding around the center. The rubber thread, for example, is obtained by vulcanizing a rubber composition including a natural rubber, or a mixture of natural rubber and a synthetic polyisoprene, a sulfur, a vulcanization auxiliary agent, a vulcanization accelerator, and an antioxidant. The rubber thread is wound around the center in elongation of about 10 times length to form the wound core.

When preparing a multi-piece golf ball comprising at least three layers, the intermediate layer includes, for example, a thermoplastic resin such as a polyurethane resin, an ionomer resin, Nylon, and a polyethylene; a thermoplastic elastomer such as a polystyrene elastomer, a polyolefin elastomer, a polyurethane elastomer, a polyester elastomer, a polyamide elastomer.

Examples of the ionomer resin are one prepared by neutralizing at least a part of carboxyl groups in a copolymer composed of ethylene and α,β-unsaturated carboxylic acid with a metal ion, and one prepared by neutralizing at least a part of carboxyl groups in a terpolymer composed of ethylene, α,β-unsaturated carboxylic acid and α,β-unsaturated carboxylic acid ester with a metal ion. Examples of the α,β-unsaturated carboxylic acid are acrylic acid, and methacrylic acid. Examples of the α,β-unsaturated carboxylic acid ester are methyl ester, ethyl ester, propyl ester, n-butyl ester, isobutyl ester and the like of acrylic acid, methacrylic acid. The metal for neutralizing the carboxyl group includes alkali metal such as sodium, potassium, and lithium; or alkali earth metal such as magnesium, calcium; or divalent transition metal such as zinc, and copper. Further, the above ionomer resin can be used as the mixture thereof in order to obtain the desired resilience and hardness.

The intermediate layer may further include a filler such as barium sulfate, a colorant such as titanium oxide, and an additive such as a dispersant, an antioxidant, an UV absorbent, a light stabilizer, and a fluorescent brightener, in addition to the base component such as the rubber and the thermoplastic resin.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

(1) Evaluation Method (1-1) Luster (Brilliance)

The golf balls where the mark was formed were visually observed and evaluated according to the following criteria.

Excellent: The luster was even more sharply observed.

Good: The luster was sharply observed.

Fair: The luster was slightly observed.

Poor: The luster was not observed.

(1-2) Visibility

The golf ball having a mark thereon was located on the grass in a fine weather. Ten golfers approached the golf ball gradually from the position which was as far as 50 m from the golf ball, and registered the distance between the golf ball and the position where the golfer recognized the existence of the mark on the golf ball. The distances of the ten golfers were averaged and regarded as the result of each golf ball.

(1-3) Durability

Each golf ball was hit 100 times repeatedly with a driver (W#1) attached to a swing robot manufactured by TRUETEMPER CO, at the head speed of 45 m/sec. The durability was evaluated based on the following criteria. The evaluation of the durability was comprehensive evaluation of all the layers, because the luster and the visibility will be lowered, even if at least one layer of the clear coating layer, the clear paint layer and the mark peels off.

Excellent: None of the clear coating layer, the clear paint layer and the mark peeled off.

Good: At least one of the clear coating layer, the clear paint layer and the mark peeled off in a degree of less than 1 mm.

Fair: At least one of the clear coating layer, the clear paint layer and the mark peeled off in a degree of from 1 to 2 mm (exclusive).

Poor: At least one of the clear coating layer, the clear paint layer and the mark peeled off in a degree of 2 mm or more.

(2) Production of the Two-piece Golf Ball (2-1) Preparation of Solid Core

The rubber composition shown in Table 1 was kneaded and pressed in upper and lower molds each having a spherical cavity at the heating condition of 160° C. for 13 minutes to obtain the solid core in a spherical shape having a diameter of 39.3 mm.

TABLE 1

| Core formulation | Amount (parts) |
|---|---|
| Polybutadiene rubber | 100 |
| Zinc oxide | 5.6 |
| Zinc acrylate | 22.0 |
| Calcium carbonate | 21.0 |
| Dicumyl peroxide | 1.85 |

Note on Table 1:
Polybutadiene rubber: BR-11 (cis content: 96%) available from JSR Co.
Zinc acrylate: "ZNDA-90S" produced by NIHON JYORYU KOGYO Co., LTD.
Zinc oxide: "Ginrei R" produced by Toho-Zinc Co.
Dicumyl peroxide: "Percumyl D" produced by NOF corporation.

(2-2) Preparation of the Cover Material

The materials shown in Table 2 were mixed using a twin-screw kneading extruder to obtain the cover composition in the form of pellet. The extrusion was conducted in the following conditions:

screw diameter=45 mm, screw revolutions=250 rpm, screw L/D=35, and the cover composition was heated to from 200° C. to 260° C. at the die position of the extruder.

TABLE 2

| Cover formulation | Amount (parts) |
|---|---|
| Himilan 1605 | 40 |
| Himilan 1706 | 30 |
| Himilan 1707 | 30 |
| Titanium oxide | 2 |

Notes on Table 2:
HIMILAN 1605: an ionomer resin of a sodium ion-neutralized ethylene-methacrylic acid copolymer, available from MITSUI-DUPONT POLY-CHEMICAL CO., LTD.
HIMILAN 1706: an ionomer resin of a zinc ion-neutralized ethylene-methacrylic acid copolymer, available from MITSUI-DUPONT POLY-CHEMICAL CO., LTD.
HIMILAN 1707: an ionomer resin of a sodium ion-neutralized ethylene-methacrylic acid copolymer, available from MITSUI-DUPONT POLY-CHEMICAL CO., LTD.

(2-3) Preparation of the Golf Ball Body

The cover composition thus prepared was directly injection-molded onto the core to form the cover, thereby obtaining the two-piece golf ball having a diameter of 42.7 mm.

The upper and lower molds for forming the cover have a spherical cavity with dimples. The part of the dimples can serve as a hold pin which is retractable. When forming the golf ball body, the hold pins were protruded to hold the core, and the resin heated at 210° C. was charged into the mold held under the pressure of 80 tons for 0.3 seconds. After the cooling for 30 seconds, the molds were opened and then the golf ball body was discharged.

(2-4) Preparation of the Mark

A pigment was mixed with the two-component curing type of PAD-EPH ink manufactured by Navitas Co, to prepare an ink composition for the mark. The amount of the pigment was adjusted to satisfy the color tone of the mark shown in Table 3. The mark was formed on the surface of the golf ball by pad printing method with the above ink composition. In terms of the golf balls No.8 and No.9, the luster material was blended in the ink composition to form the mark including the luster material, according to the formulation (dry base) shown in Table 3.

(2-5) Formation of the Clear Coating Layer

In terms of the golf balls No.1 to No.7, the luster material was blended into the commercial epoxy paint to prepare the composition for the clear coating layer, according to the formulation (dry base) shown in Table 3. The clear coating composition was coated on and around the mark (surrounding of the mark), and dried to form the clear coating layer. Subsequently, the clear paint layer was formed on the clear coating layer.

In terms of the golf balls No.10 to No.16, the luster material was blended into the commercial urethane paint to prepare the composition for the clear coating layer, according to the formulation (dry base) shown in Table 3. The clear coating composition was coated on the whole surface of the golf ball body, and dried to form the clear coating layer which concurrently serves as the clear paint layer.

The detail of the epoxy paint, the urethane paint, the luster material, and the clear paint layer used above are as follows. Further, the same urethane paint used for the golf balls No. 10 to No.16 was also used as the clear paint layer of the golf balls No.1 to No.9. Luster material: Metashine MC1080RG available from Nihon Sheet Glass Co, having an average particle size of 8 $\mu$m, and an average thickness of 1 $\mu$m.

Epoxy paint: PAD-EPH "00X medium (resin component: 43%)" available from Navitas Corporation.

Urethane paint: Two-component curing type of urethane paint

Formulation of the curing agent and the base resin: NCO/OH=1.2/1.0 (molar ratio)

Base resin: Mixture of a polyester polyol and polyether polyol, having a hydroxyl value of 82 mgKOH/g Curing agent: hexamethylenediisocyanate The obtained golf balls were evaluated in terms of the luster, the visibility and the durability. The results were shown in Table 4.

TABLE 3

| | Characteristics of Mark | | | | Clear coating layer | | | |
|---|---|---|---|---|---|---|---|---|
| Golf ball No. | L | a | b | Luster material | Base resin | Luster material | Clear paint layer | Note |
| 1 | 14.88 | 2.10 | 3.16 | — | EP | 10 | PU | Golf balls 1 to 7: |
| 2 | 32.81 | 0.15 | 0.29 | — | EP | 10 | PU | Clear paint layer |
| 3 | 43.21 | 2.55 | 3.28 | — | EP | 10 | PU | is formed on the |
| 4 | 14.88 | 2.10 | 3.16 | — | EP | 0.3 | PU | clear coating layer. |
| 5 | 14.88 | 2.10 | 3.16 | — | EP | 2 | PU | |
| 6 | 14.88 | 2.10 | 3.16 | — | EP | 18 | PU | |
| 7 | 14.88 | 2.10 | 3.16 | — | EP | 25 | PU | |
| 8 | — | — | — | 10 | — | — | PU | Luster material is |
| 9 | — | — | — | 30 | — | — | PU | contained in the mark. |
| 10 | 14.88 | 2.10 | 3.16 | — | PU | 5 | none | Clear coating layer |
| 11 | 32.81 | 0.15 | 0.29 | — | PU | 5 | none | also serves as a |
| 12 | 43.21 | 2.55 | 3.28 | — | PU | 5 | none | clear paint layer. |
| 13 | 14.88 | 2.10 | 3.16 | — | PU | 0.3 | none | |
| 14 | 14.88 | 2.10 | 3.16 | — | PU | 0.8 | none | |
| 15 | 14.88 | 2.10 | 3.16 | — | PU | 9 | none | |
| 16 | 14.88 | 2.10 | 3.16 | — | PU | 15 | none | |

Luster materia: parts by mass based on 100 parts by mass of Base resin
EP: Epoxy resin type,
PU: Polyurethane resin type

TABLE 4

| Golf ball | Evaluation | | |
|---|---|---|---|
| | Luster | Visibility | Durability |
| 1 | Excellent | 12.0 | Excellent |
| 2 | Good | 10.3 | Excellent |
| 3 | Poor | 6.2 | Excellent |
| 4 | Fair | 6.8 | Excellent |
| 5 | Good | 10.1 | Excellent |
| 6 | Excellent | 13.8 | Good |
| 7 | Excellent | 15.6 | Fair |
| 8 | Poor | 6.1 | Excellent |
| 9 | Good | 9.8 | Poor |
| 10 | Excellent | 11.5 | Excellent |
| 11 | Good | 10.2 | Excellent |
| 12 | Poor | 6.4 | Excellent |
| 13 | Fair | 7.0 | Excellent |
| 14 | Good | 9.1 | Excellent |
| 15 | Excellent | 12.1 | Good |
| 16 | Excellent | 13.3 | Fair |

Visibility: m

The golf balls No. 1, 2, 4 to 6, and 7 are the cases that the clear coating layer includes the luster material comprising a glass flake and a titanium dioxide layer coated on the surface of the glass flake, that the clear coating layer covers the mark having a color tone satisfying L≦40, and that the urethane clear paint layer is further formed on the clear coating layer. All of the golf balls were excellent in the luster, the visibility and the durability. On the other hand, the golf ball No. 3 is the case that the mark has a color tone of L>40.

The comparison among the golf balls No.1 to No.3 indicated that the luster depends on the L value of the mark formed on the surface of the golf ball body and that the luster becomes stronger as the L value is getting smaller. Especially, the luster was very good when the L value is not more than 15. On the other hand, the luster of the golf ball No.3 was not observed, because the mark had a color tone of L>40.

Further, the comparison among the golf balls No.4 to No.7 indicated that the amount of the luster material affects the luster and the durability. Namely, the luster is getting strong as the amount of the luster material increases, while the durability tends to be lower. Especially, the luster of the golf ball No.4 tended to be lower, because the amount of the luster material was as low as 0.3 parts by mass. On the other hand, the durability of the golf ball No.7 tended to be lower, because the amount of the luster material was as much as 25 parts by mass. In addition, the results of the golf balls No.5 and No.6 indicated that the luster and the durability are well-balanced when the amount of the luster material is ranging from 0.5 to 20 parts by mass.

The golf balls No.8 and No.9 are the cases that the luster material was contained in the mark. Regarding the golf ball No.8, the luster was not observed, although the amount of the luster material of the golf ball No.8 was as much as that of the golf ball No.1 (10 parts by mass). This result suggested that the luster material did not work sufficiently, due to the opacifying effect of the pigment contained in the mark. On the other hand, regarding the golf ball No.9 where the amount of the luster material was increased, the durability was remarkably lowered, although the luster was observed in a sufficient degree. These results indicated that the golf ball of the present invention is excellent in all of the luster, the visibility and the durability, compared with the conventional golf ball where the luster material was contained in the mark.

The golf balls No.10 to No.16 were the cases that the clear coating layer containing the luster material also served as the clear paint layer. Regarding the relation between the L value of the mark and the luster, the same results as described above were obtained for the golf balls No.10 to No.12. Regarding the relation between the amount of the luster material, and the luster and the durability, the same results as described above were obtained for the golf balls No.13 to No.16. Further, it has been apparent that the amount of the luster material is preferably ranging from 0.5 part to 10 parts by mass when the clear coating layer containing the luster material also serves as the clear paint layer. The relationship between the luster and the visibility further indicated that the golf ball having the high degree of the luster is excellent in the visibility. Thus, the mark could be recognized from the far position.

According to the present invention, it is possible to provide a golf ball having the individualized appearance as well as the improved visibility, which the mark should inherently provide, by imparting the luster to the mark, without lowering the durability of the mark.

This application is based on Japanese Patent application No.2002-332497 filed on Nov. 15, 2002, the contents of which are hereby incorporated by reference.

What is claimed is:

1. A golf ball comprising:

a mark on the surface of the golf ball body, and a clear coating layer covering the mark, the mark having a color tone satisfying L≦40 specified by Lab color system, wherein the clear coating layer includes the base resin; and the luster material comprising a glass flake and a metal oxide layer coated on the surface of the glass flake.

2. The golf ball according to claim 1, wherein the clear coating layer is an outermost layer, and includes the luster material in an amount of 0.5 to 10 parts by mass based on 100 parts by mass of the base resin.

3. The golf ball according to claim 2, wherein the clear coating layer covers the mark and a surrounding of the mark only.

4. The golf ball according to claim 2, wherein the clear coating layer covers a whole surface of the golf ball body, thereby covering the mark.

5. The golf ball according to claim 2, wherein the base resin is a two-component curing urethane resin.

6. The golf ball according to claim 1, wherein a clear paint layer is further formed on the clear coating layer, and the clear coating layer includes the luster material in an amount of 0.5 to 20 parts by mass based on 100 parts by mass of the base resin.

7. The golf ball according to claim 6, wherein the clear coating layer covers the mark and a surrounding of the mark only.

8. The golf ball according to claim 6, wherein the clear coating layer covers a whole surface of the golf ball body, thereby covering the mark.

9. The golf ball according to claim 6, wherein the base resin is an epoxy resin.

10. The golf ball according to claim 9, wherein the clear paint layer includes a two-component curing urethane resin as a base resin.

11. The golf ball according to claim 1, wherein the metal oxide is titanium oxide.

12. The golf ball according to claim 1, wherein the luster material comprises a glass flake and a titanium oxide layer coated on the whole surface of the glass flake.

13. The golf ball according to claim 12, wherein the titanium oxide has a rutile structure.

14. The golf ball according to claim 1, wherein the luster material has an average particle size of 10 $\mu$m to 100 $\mu$m.

* * * * *